United States Patent [19]

Fichtner

[11] 4,441,446

[45] Apr. 10, 1984

[54] IMPROVEMENTS IN WINDSURFING BOARDS

[75] Inventor: Hans Fichtner, Seeshaupt, Fed. Rep. of Germany

[73] Assignee: Mistral Windsurfing AG, Nurensdorf, Fed. Rep. of Germany

[21] Appl. No.: 441,734

[22] Filed: Nov. 15, 1982

Related U.S. Application Data

[63] Continuation of Ser. No. 221,824, Dec. 31, 1980, abandoned.

[30] Foreign Application Priority Data

Mar. 20, 1980 [DE] Fed. Rep. of Germany ..... 8007676

[51] Int. Cl.[3] ..... B63B 1/22

[52] U.S. Cl. ..... 114/39; 114/283; 114/284; 441/74

[58] Field of Search ..... 114/39, 271, 280, 282, 114/283, 284; 441/74, 79, 68

[56] References Cited

U.S. PATENT DOCUMENTS

| | | | |
|---|---|---|---|
| 1,075,726 | 10/1913 | Prosser | 114/283 |
| 3,636,907 | 1/1972 | Scarritt, Sr. | 114/283 |
| 3,777,325 | 11/1973 | Bristol | 9/310 B |

FOREIGN PATENT DOCUMENTS

| | | | |
|---|---|---|---|
| 1551426 | 8/1979 | United Kingdom | 441/74 |

*Primary Examiner*—Sherman D. Basinger
*Attorney, Agent, or Firm*—Armstrong, Nikaido, Marmelstein & Kubovcik

[57] ABSTRACT

A windsurfing board with a hull, a mast and a wishbone or other spar for winging out the sail has side fin plates with lower stabilizing faces and an adjustment system for steplessly changing the level of such fin plates, or only producing two positions of adjustment so that such fin plates are under or clear of the water. The lower position under the water is designed for producing better planing properties of the windsurfer while the top position is used for sailing under only a light wind.

17 Claims, 8 Drawing Figures

IMPROVEMENTS IN WINDSURFING BOARDS

This is a continuation of application Ser. No. 221,824, filed Dec. 31, 1980, now abandoned.

BACKGROUND OF THE INVENTION (i) Field to Which the Invention Relates

The present invention is with respect to a windsurfing board with a surfboard-like hull, a mast joined to said hull by a universal joint, a sail, a spar for winging out said sail, and at least on a stern part of said hull stabilizing faces on the two sides of said hull, said stabilizing faces being generally horizontal when viewed in a direction normal to the median line running through the middle of the hull.

(ii) The Prior Art

Such a windsurfing board hull has been put forward in the past, see for example German Gebrauchsmuster Pat. No. 7,924,335, in which case horizontal stabilizing fin plates are placed to the two sides of the stern and forming a single structure therewith so that in the unloaded condition of the hull they are to be over the waterline. The hull of the windsurfer is V-like in cross-section at the fore end with the point of the V running downwards while in the middle part of the hull, the hull's lower face is convexly curved downwards and in the stern part it is convexly curved between the generally horizontal stabilizing faces. The purpose of this form of the hull of the known surfing board is that of increasing stability, more specially when sailing before the wind without increasing the wetted surface, because this would make for a decrease in speed.

It is known in the art that windsurfing board of the displacement type are faster than other windsurfers when the wind is low and that, when sailed in a strong wind, are slower because windsurfing board without such fin plates go over into the planing condition more readily and earier, such a planing condition making it possible for the hull to be sailed at a much higher speed than would be possible, in theory, if the hull is simply sailed as a displacement hull.

SHORT OVERVIEW OF THE INVENTION

For this reason, one purpose of the present invention is that of designing a windsurfing board of the sort noted in the case of which the form of the wetted part of the hull may be readily put in line with changing wind conditions and/or the course sailed.

This purpose and other purposes are effected by the present invention because the stabilizing fin plates are designed as plates running out from the side of the hull and able to be adjusted in height between an upper position in which their generally horizontal guide faces are over and clear of the water, in the loaded condition of the windsurfing board, and in the lower condition are under the waterline.

Because of this design measure the useful effect is produced in a simple way that the underwater part of the windsurfing board hull is able to be changed over from a displacement hull into a gliding hull.

As part of a preferred measure of the invention, the windsurfing board hull has a displacement design in its under-water part.

As part of a more specially preferred measure of the invention, the stabilizing fin plates are designed stretching as far as the fore part of the hull.

In the fore part the stabilizing fin plates may be hingedly fixed or, more specially, made in one piece with the synthetic resin of the windsurfing board hull, such a joining on of the fin plates being in the fore part of the hull.

More specially, the windsurfing board hull is so designed that the stabilizing fin plates have an outline which is smoothly joined with the outline of the rest of the windsurfer hull so that, generally speaking, the hull is more pleasing to the eye. For this purpose the fin plates are made so as to become narrower towards the fore end and are smoothly joined up without any steps or the like with the outline of the fore part.

Adjustment in height may be undertaken by at least one adjustment system, able to be worked by a person on the top of the hull, more specially with the foot. This is responsible for the useful effect that adjustment of the under-water hull may be undertaken while the craft is underway and without the person using the windsurfer having to make use of his hands which, in any case, are needed for gripping and guiding the wishbone.

The foot-worked or other system is naturally designed without any outwardly running edges so that there is no danger of injury.

Such an adjustment system for changing the level of the fin plates is to be present, at least, in the aft part of the windsurfing board, the form of the stabilizing fin plates then being in line with the natural line of bending of the plates.

In the case of a further working example of the invention, a further adjustment system of the same sort may be present to the fore of the mast. This makes certain of the best form of the guide faces from the hydrodynamic point of view, because the bending of the fin plates is caused at two points.

As part of a further working example of the invention, the two adjustment systems may have two end positions in which they are kept automatically, for example, and more specially, past two dead center positions of the adjustment system, the end adjustment points answering to the bending line which is optimum from the hydrodynamic point of view.

In the case of a further form of the invention, one of the adjustment system or the two of them may be stepless so that the best possible profile of the stabilizing fin plates may be separately trimmed.

The adjustment system may take the form of a crank, rack and wheel or cam system. It is furthermore possible for the elastic properties of synthetic resin to be used, the preferred end positions of the fin plates then answering to the relaxed positions, while in positions inbetween the fin plates are under a bending stress. In this way it is possible to make certain of the desired adjustment of the guide faces or fin plates in the simple way noted.

In the case of more specially preferred working examples of the invention, the part joining the fin plates with the adjustment system or systems is placed in the plane of the gunwale, this stopping any turbulent flow with a braking effect.

A specially simple form of this system makes use of a plate or disk in line with the gunwale and having an ecentric pin thereon, taken up in a slot in the slide facing the hull.

In the case of further possible forms of the invention further casings or the like may be present.

The stabilizing fin plates may naturally furthermore be designed with outwardly running parts like the cross-section of a bilge keel, this making sailing hard on the wind more readily possible.

It will be clear that the fin plates, in connection with the windsurfing board hull, are so designed that the space between them and necessary to let upward and downward motion take place, is kept as narrow as possible for making the design pleasing to the eye.

LIST OF FIGURES

An account will now be given of working examples of the invention using the figures.

DETAILED ACCOUNT OF WORKING EXAMPLES OF THE INVENTION

Figure 1:
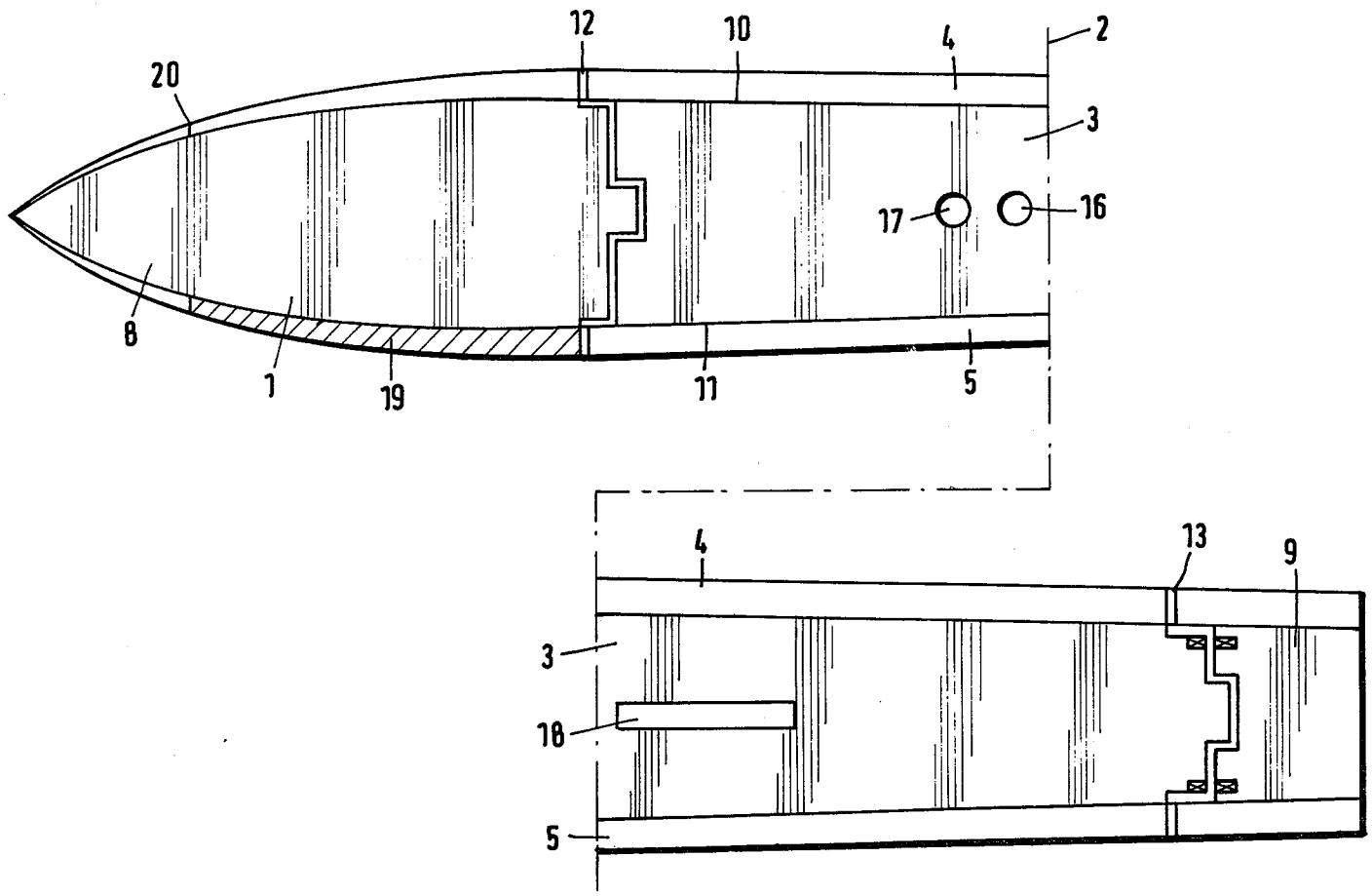
FIG. 1 is rough plan view of a windsurfing board hull designed on the lines of the present invention.
Figure 2:
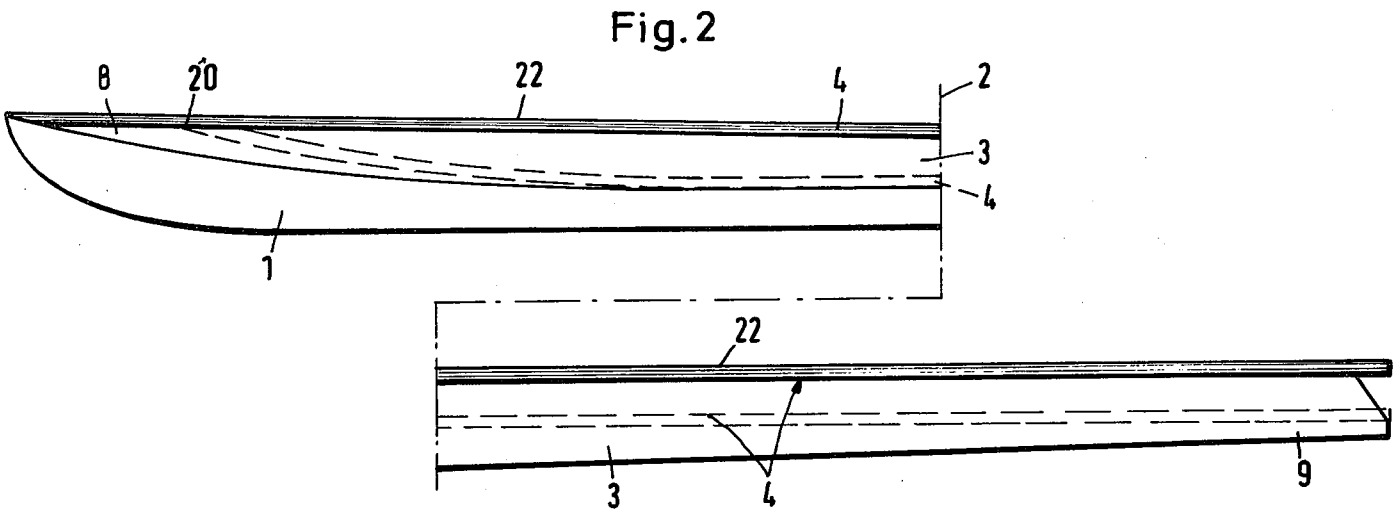
FIG. 2 is a side view of the windsurfing board hull of FIG. 1.

As will be seen from the figures, and more specially FIGS. 1 and 2, in which the hull is to be seen in two pieces, cut at line 2, the hull 1 is made up of a main body and two fin plates 4 and 5 to the sides thereof, which have lower guide faces 6 and 7.

As will be seen more specially from FIG. 1, the fin plates 4 and 5 have such a form as to be in harmony with the rest of the windsurfer hull, and they become narrower towards the bows 8. Furthermore, the outline of the fin plates 4 and 5 is in line with the outline of the stern 9. The two spaces or gaps 10 and 11 (necessary for adjustment in level of the fin plates 4 and 5) between the main hull 3 and the fin plates 4 and 5 are made as narrow as possible so that to the eye it seems that there is only a single top deck face. As will furthermore be seen from the rough view of FIG. 1 there is an adjustment system 12 near the bows 8 and an adjustment system 13 near the stern 9 of the windsurfing board hull 1, these systems being detailed further on and being used for changing the level of fin plates 4 and 5 having stabilizing faces 6 and 7 in relation to the gunwales 14 and 15 (see FIG. 3) of the hull 1. In FIG. 1 further parts of the windsurfing board hull 1 will be seen in the form of two eyes 16 and 17 for taking up the universal joint at the foot of the mast and there is furthermore a centerboard guide 18 for a sliding centerboard, of which, however, no detailed account is given here because of its not having any connection with the present invention.

As will furthermore be seen from FIG. 1, the fin plates 4 and 5 are joined with the windsurfing board hull 1 in the bows part 8 and extend rewardly from the bow tip of the hull. In this respect it is possible to have within the shaded part of fin plate 5 a hinge for joining the fin plate with the hull 3, such a hinge point being marked for example at 20 for hinging the fin plate 4.

It is furthermore possible for the fin plates 4 and 5 to be joined up with the main hull so as to form a single structure therewith, spaces or gaps 10 and 11 then starting in the bows part 8 at a point 19 in the shaded part and running back as far as the stern 9.

In any case, the design will be such that a smooth, unbroken outline is produced.

In FIG. 2 the upper level of the fin plates 4 and 5 is marked in unbroken lines while the lowermost position, which is best for planing, is marked in broken lines. From the view of FIG. 2 the reader will see that a line of bending with useful properties from the hydrodynamic point of view is to be produced.

Figure 3:
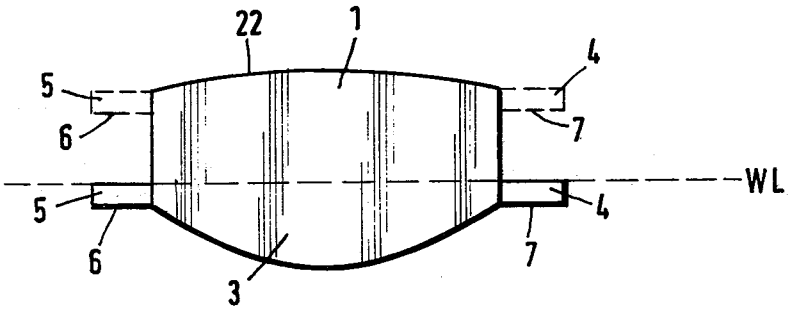
FIG. 3 is a stern-on view of the windsurfing board hull of FIGS. 1 and 2.

As will be clear from FIG. 3, the stabilizing faces 6 and 7 under fin plates 4 and 5 are in the lowermost position, that is to say under the water-line in the loaded condition of the windsurfing board hull, this being desired for planing, so that such planing is made more readily possible. In the position to be seen in broken lines in FIG. 3, the stabilizing faces 6 and 7 are over and clear of the water-line so that in this displacement-position the wetted face or surface is kept as low as possible. Furthermore, in this case, there is the useful effect of a greater area for resting the hull on the ground.

To an expert it will be clear furthermore from FIG. 2 that the position designed for planing, takes the form of a line of bending generally answering to, and being representative of the water-line to be expected on planing.

Figure 4:
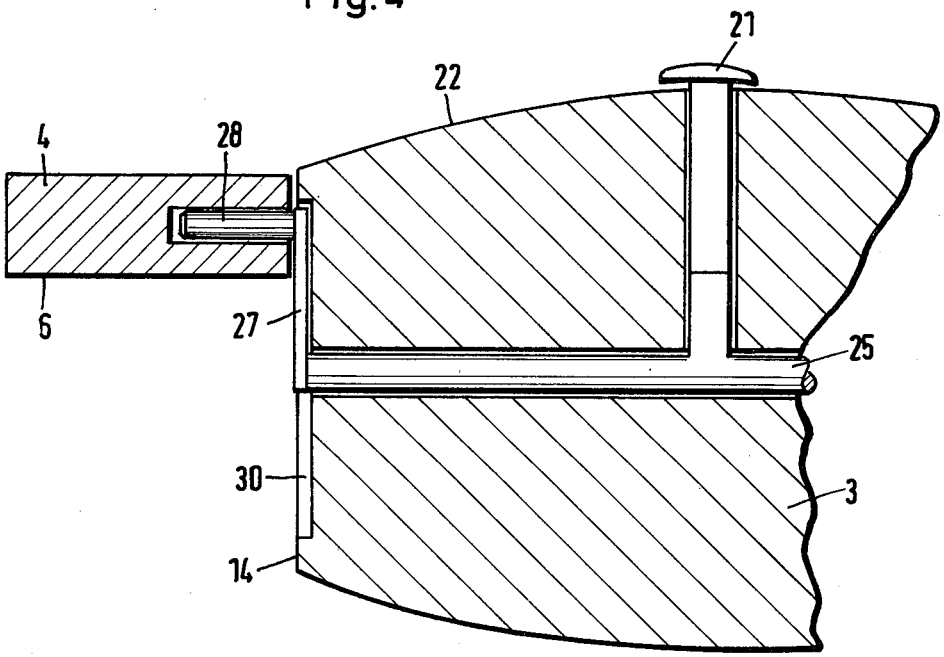
FIG. 4 is a view of a possible design of an adjustment system in section.
Figure 5:
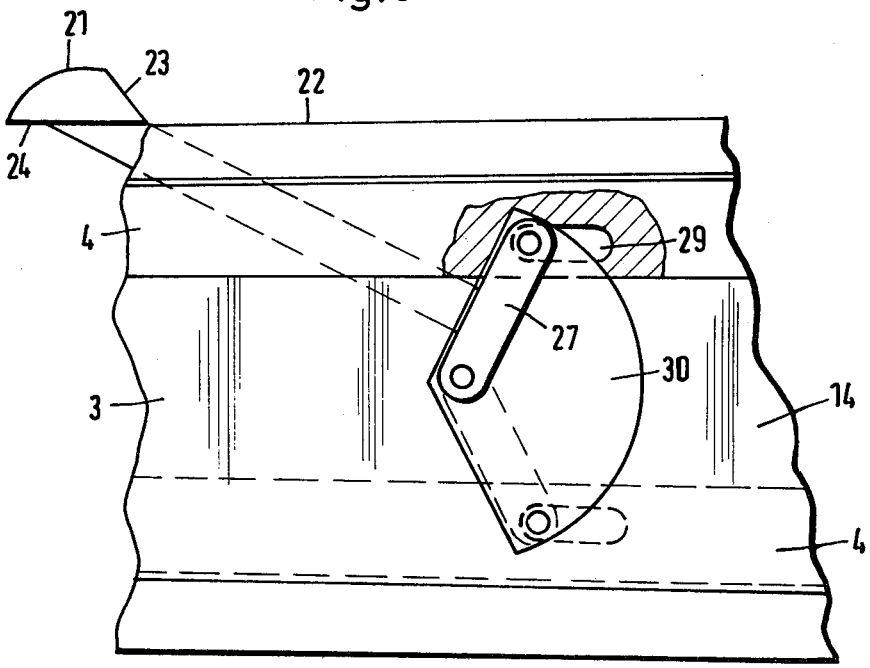
FIG. 5 is a partly cut-away side view of the adjustment system of FIG. 4.

FIGS. 4 and 5 are diagrammatic views of a possible form of the adjustment system 12 or 13.

As will be seen in these figures, a crank driving system is placed in the main hull 3 of the windsurfing board 1, the system being worked by way of a foot lever 21 sticking up clear of the top deck face 22 of the hull 1, the lever having two stop faces 23 and 24 at which it will be resting on the deck top face 22 in its end positions. However, the adjustment lever 21 is only an example and other ways of driving may be used.

The crank driving system, which is to be marked generally as 25, is made up of a main pin 25 stretching out to the two sides as far as the gunwales 14 and 15, the crank levers 27 and the crank pins 28. The crank pins 28 are taken up in side openings on the side, turned towards the main hull 3, of fin plates 4 and 5, each such opening being a slot 29 to let a turning or rocking motion of crank 27 take place, which itself if supported in a cutout 30, which, with respect to its form and depth on the one hand takes into the account the thickness of crank 27 and on the other hand its turning or rocking motion.

In the case of a preferred form of the invention, crank 27 takes the form of a disk or plate so that the gunwales 14 and 15 are kept smooth and not made with any outwardly running parts which would have a braking effect on the hull.

In addition to this, and furthermore in place of it, it is naturally possible to have casings or shroudings for making the hull more streamlined.

Figure 6:
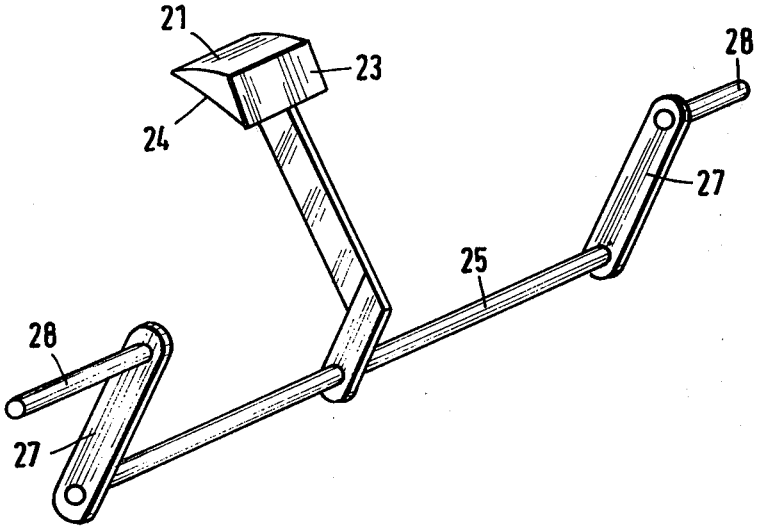
FIG. 6 is a view of one form of a crank drive of the adjustment system of FIGS. 4 and 5, as seen in perspective.

In FIG. 6 the reader will see a still further possible form of the driving system 12 or 13, in the form of a crank rod, as a possible working example of the invention.

Figure 7:
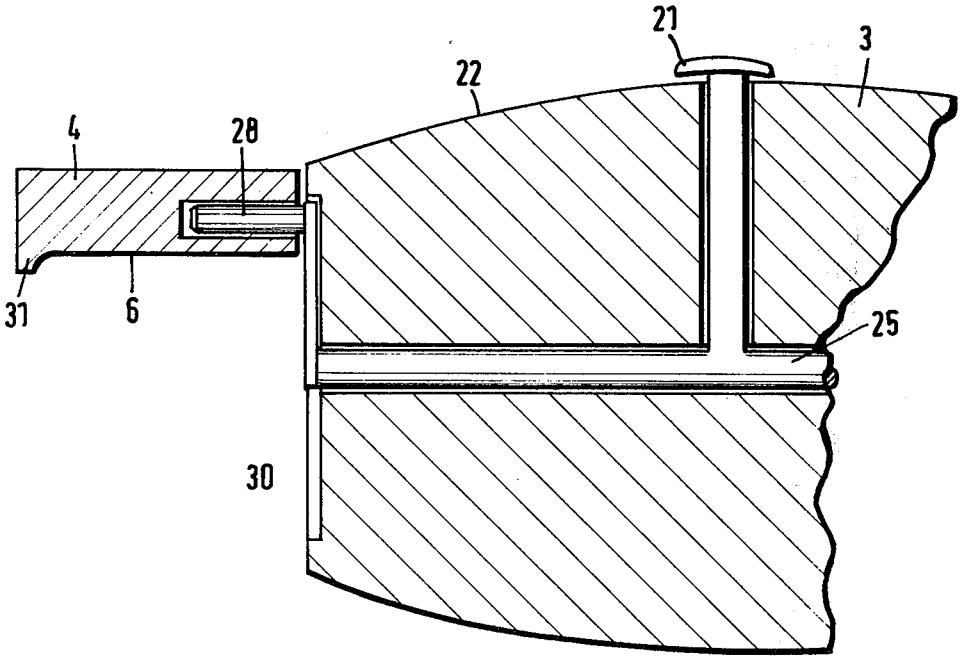
FIG. 7 is a changed form of the working example of FIG. 4.

FIG. 7 is a view on the same lines as FIG. 4, in which case on fin plates 4 and 5 or the stabilizing faces 6 and 7, and generally for the full length of fin plates 4 and 5 there are outwardly running parts 31 like the outwardly angled parts of a hull in section, which in the lowered planing position of the fin plates 4 and 5 have a stepped-up guiding effect for keeping the hull on course so that, there being less drift, the board may be kept harder on the wind.

Figure 8:
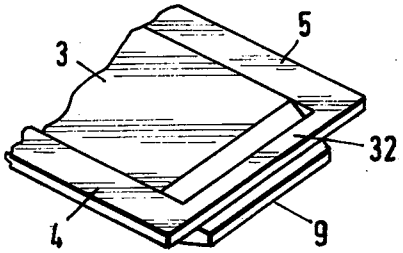
FIG. 8 is a rough stern view of a further working example of the invention.

FIG. 8 is a view of a further detail of a possible working example, in the case of which the ends of the fin plates 4 and 5 are joined together at the stern 9 of the windsurfer hull by a cross-piece 32, this working example offering usefull effects with respect to stability and furthermore with respect to the general look of the hull.

I claim:

1. In a windsurfing board comprising a surfboard-like hull, means for joining a sail to the hull, fin plate means with stabilizing faces on at least two sides and the stern part of said hull, and single foot operated adjusting means for adjusting the level of said fin plate means by a person on top of the hull;

wherein said fin plate means are substantially horizontal when viewed in the direction normal to a median line of said hull and form a smooth-unbroken outline with said hull; and wherein said adjustment means has a lever extending upwardly through a portion of said hull; said adjusting means further has two limiting end positions, an upper position for placing the fin plate means above the water line in a loaded condition and a lower position for placing the fin plate means below the water line, thereby enabling the hull shape to be changed between a displacement hull and a gliding hull.

2. The windsurfing board as claimed in claim 1, wherein the hull is designed as a displacement hull.

3. The windsurfing board as claimed in claim 1, wherein said fin plate means are designed for stretching as far as the bows part of said hull.

4. The windsurfing board as claimed in claim 1, wherein said fin plate means are hinged to the bows part of the hull.

5. The windsurfing board as claimed in claim 1, wherein said fin plate means are molded onto synthetic resin of the hull for forming a single-piece bendable structure in the bows part of the hull.

6. The windsurfing board as claimed in claim 1, wherein the fin plate means have an outline smoothly joining the outline of the bows.

7. The windsurfing board as claimed in claim 1, having a foot-worked part for operation of said adjusting means, said foot-worked part being free of outwardly running edges.

8. The windsurfing board as claimed in claim 1 having the said adjusting means at least in the stern part of the hull.

9. The windsurfing board as claimed in claim 8 having a further adjusting means of the same sort placed to the fore of the means for joining a sail to the hull, for bending the fin plate means.

10. The windsurfing board as claimed in claim 1, wherein said adjusting means has two limiting upper and lowermost end positions answering to an optimum line of bending of said fin plate means.

11. The windsurfing board as claimed in claim 1 wherein said adjusting means has two dead center positions past which it is moved on changing the fin plate into the upper and lower positions, such motion past such dead center points giving a self-locking effect.

12. The windsurfing board as claimed in claim 1, wherein stepless adjustment of said adjusting means is possible.

13. The windsurfing board as claimed in claim 1, wherein said adjustment system is designed as a crank.

14. The windsurfing board as claimed in claim 1, wherein said adjusting means is designed with a plate.

15. The windsurfing board as claimed in claim 1 wherein said fin plate means have lower faces which are angled in cross-section like a bilge keel cross-section for the full length of the fin plate means.

16. In a windsurfing board comprising a surfboard-like hull, means for joining a sail to the hull, fin plate means with stabilizing faces on at least two sides and a stern part of said hull and a foot operated adjusting means for adjusting the level of said fin plate means by a person on top of the hull;

wherein said fin plate means are substantially horizontal when viewed in the direction normal to a median line of said hull, form a smooth-unbroken outline with said hull and extend from the bow tip of said hull to the stern of the hull; and wherein said adjusting means has two limiting end positions, an upper position for placing the fin plate means above the water line in a loaded condition and a lower position for placing the fin plate means below the water line, thereby enabling the hull shape to be changed between a displacement hull and a gliding hull.

17. The windsurfing board as claimed in claim 16, wherein said fin plate means are joined together at the stern of the hull by a cross-piece.

* * * * *